US007574777B1

(12) United States Patent
Fuller et al.

(10) Patent No.: US 7,574,777 B1
(45) Date of Patent: Aug. 18, 2009

(54) RESILIENT CLIP-ON MEMBER FOR DUST MOP OR OTHER WORK MEMBER

(75) Inventors: Daniel T. Fuller, Manchester, GA (US); Robert Lee Roberson, Woodbury, GA (US)

(73) Assignee: Woodbury Box Company, Inc., Thomaston, GA (US)

( * ) Notice: Subject to any disclaimer, the term of this patent is extended or adjusted under 35 U.S.C. 154(b) by 452 days.

(21) Appl. No.: 11/415,244

(22) Filed: May 2, 2006

(51) Int. Cl.
*B25G 1/10* (2006.01)

(52) U.S. Cl. ..... 16/436; 16/110.1; 15/146; 15/147.1; 15/150; 15/172; 403/289

(58) Field of Classification Search ..... 16/436, 16/422, 110.1, 172, 178; 15/144.1, 144.2, 15/146, 147.1, 147.2, 228, 229.6, 231, 150; 403/301, 309, 321, 344, 289
See application file for complete search history.

(56) References Cited

U.S. PATENT DOCUMENTS

| | | | | |
|---|---|---|---|---|
| 1,644,799 | A | | 10/1927 | Toplitz |
| 1,708,052 | A | | 4/1929 | Channell |
| 2,240,155 | A | | 4/1941 | Closson |
| 2,736,915 | A | | 3/1956 | Le Febvre et al. |
| 2,861,287 | A | | 11/1958 | Scalf |
| 2,940,800 | A | * | 6/1960 | Knapp ..... 403/58 |
| 2,943,892 | A | * | 7/1960 | Hessler et al. ..... 403/58 |
| 2,967,320 | A | | 1/1961 | Short |
| 2,975,004 | A | | 3/1961 | Safianoff |
| 3,029,454 | A | | 4/1962 | Short et al. |
| 3,162,879 | A | * | 12/1964 | Smyth ..... 15/147.2 |
| 3,211,547 | A | | 10/1965 | Jarrett et al. |
| 3,692,369 | A | * | 9/1972 | Chase ..... 403/161 |
| 3,760,450 | A | | 9/1973 | Griffin et al. |
| 3,778,860 | A | | 12/1973 | Thielen |
| 3,986,225 | A | | 10/1976 | Komatsu |

(Continued)

*Primary Examiner*—William L. Miller
(74) *Attorney, Agent, or Firm*—Novak Druce + Quigg LLP

(57) ABSTRACT

A resilient device for joining a handle to a pivot bar of a wire support frame of a dust mop or other work member which allows for hands free operation to attach and remove the mop head or other work member. The holder includes a resilient member having first and second jaws extending generally parallel from one end of a base. Each of the jaws has an inner wall and an outer wall and which define at least an outer engagement slot and an inner engagement slot between their respective inner walls. The jaws also define an open end distal to the base and a closed end proximal or at the base. The outer engagement slot being arranged transversely to an axial direction of the first and second jaws proximal to an open end portion of the jaws opposite to the base. The inner slot is proximal to a closed end portion of the jaws proximal to the base. Typically, the entire apparatus can include a single or unitary piece of plastic or a single substance.

22 Claims, 5 Drawing Sheets

U.S. PATENT DOCUMENTS

| | | | | |
|---|---|---|---|---|
| 4,165,550 | A | 8/1979 | Burke | |
| 5,243,729 | A | 9/1993 | Tomm | |
| 5,455,980 | A | 10/1995 | Buchanan | |
| 5,876,141 | A | 3/1999 | Hsu | |
| 6,061,864 | A | 5/2000 | Ensson | |
| 6,098,239 | A | 8/2000 | Vosbikian | |
| 6,237,182 | B1 | 5/2001 | Cassar | |
| 6,889,917 | B2 | 5/2005 | Fahy et al. | |
| 6,931,690 | B2 | 8/2005 | Cox | |
| 7,065,838 | B2 * | 6/2006 | Mitchell et al. | 16/436 |
| 7,343,638 | B2 * | 3/2008 | Mitchell et al. | 15/144.1 |
| 2001/0029640 | A1 | 10/2001 | Cassar | |

* cited by examiner

FIG. 3A
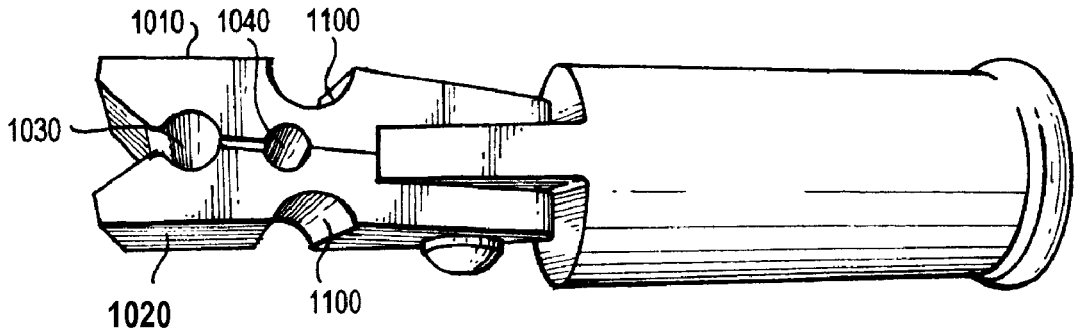
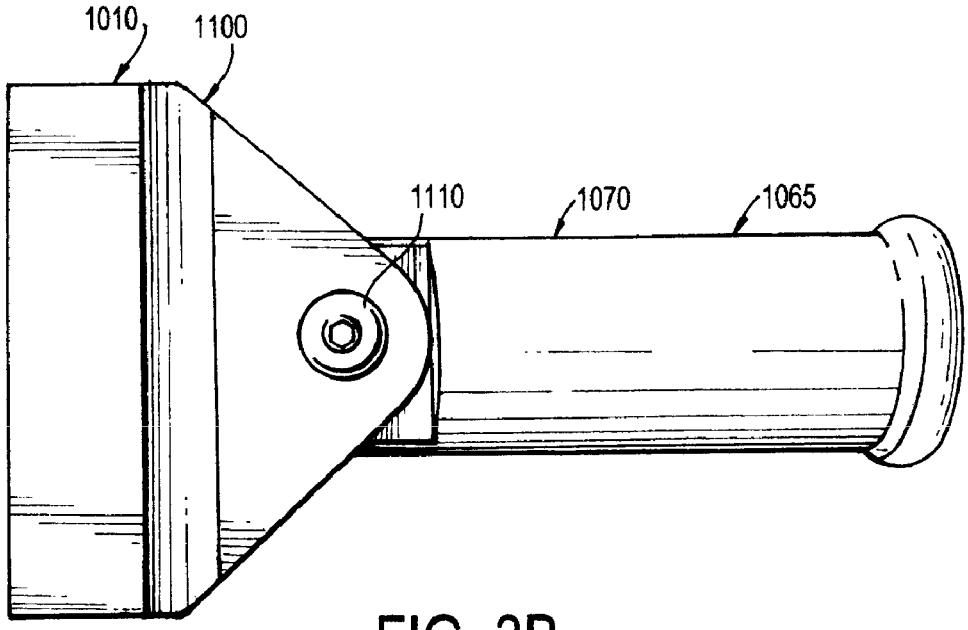
FIG. 3B

RESILIENT CLIP-ON MEMBER FOR DUST MOP OR OTHER WORK MEMBER

FIELD OF THE INVENTION

The invention is related to connectors for cleaning devices, such as a work member selected from the group consisting of a dust mop, a wet mop, and a push broom. For example, the invention is related to devices that connect a mop handle to a dust mop head.

BACKGROUND OF THE INVENTION

Dust mops, wet mops and push brooms have a problem in that it is desirable to change the mop head (or broom head) from time to time, but connections are typically either difficult to install/remove the head, or do not keep the head properly attached to the handle. For example, some mop heads utilize a series of wing nuts that are connected to a connecting portion of a handle, which often requires the user to have to handle the mop head in close visual range to attach or remove the head from the handle. Often the old mop head is dirty, dusty and/or wet, and it is not desirable to have to handle the mop head, or have it very close the user performing the removal/replacement.

In an attempt to reduce the handling, some types of mops have been constructed with a "wire" frame, as shown in FIG. 4, which is disclosed in U.S. Patent Publication No. 2001/0029640 to Cassar. Here a mop head 416 has a wire 415 (pivot bar) onto which connector clamp 417 is pushed on, and the portion of the connector clamp that is pushed onto the wire 415 (pivot bar) is typically held in place by a pivot rod mechanism 417*a* that retains a spring loaded coil (not shown) in an attempt to keep the clamp retained to the wire 415 (pivot bar). An adapter portion 418 is connected to the connector 417 at a first end and then is concentrically shaped at a second end so as to be able to receive mop handle 420. This type of connection is complex and subject to wear and tear. Additionally, the spring and pivot rod, which are typically constructed of metal, are prone to rust out, particularly after repeated exposure to water and/or damp areas.

FIG. 5 shows another variation of a mop head connector 581 disclosed in U.S. Pat. No. 6,237,182 to Cassar, wherein a unitary elastomer dust mop attachment attaches to the wire (pivot bar 561) of a mop head. The clamp includes a recess cavity 560 and upper and lower clamps 550, 552, and the clamps pivot around the lateral axis and are spaced to provide an opening. This type of attachment permits the dust mop head to pivot or flex around an object, such as the leg of a chair, so as to prevent damage to the mop head. The clamp has a lever 571 that is used to move/flex the clamps to allow attachment or removal to the wire. Thus, this type of device does not provide a true hands free operation, and in the case where the lever strikes an object that is stationary, such as a chair or table leg, the compressive force against the lever will open the clamp and cause the attachment to slip off the wire, thus unintentionally disconnecting the mop head from the wire.

Therefore, there is a need in the art to provide a clamping mechanism that does not include small parts such as coil or leaf springs and still provide tensioning that permits hands free operation. There is also a need to provide a clamping mechanism that may be constructed of a single type of polymer.

SUMMARY OF THE INVENTION

The present invention provides a clip-on connector hardware that can be made entirely of a polymer plastic and can be hands-free in operation for use with a cleaning device, for example, a dust mop, a wet mop or a push broom having a pivot bar.

The present invention is both an apparatus and method for a connector for a cleaning device. The apparatus includes a resilient member having a base, and first and second jaws extending generally parallel from one end of the base. Each of the jaws having a first inner wall and a first outer wall, the first inner wall of the first jaw faces the first inner wall of the second jaw, and each inner wall defines a respective first inner groove and a second inner groove.

The first inner groove of the first inner wall is opposed to and parallel the first inner groove of the second inner wall, and the two first inner grooves define an outer engagement slot arranged transversely to an axial direction of the first and second jaws adjacent an end portion of the jaws opposite to base.

In addition, the first inner wall has a second inner groove that is opposed and parallel to the second inner groove of the second inner wall. The two inner grooves form an integrally-formed spring to compress the outer engagement slot that grips the mop wire of the mop head. Typically, due to the structure, the entire apparatus can be comprised of a single piece of plastic or a single substance.

The outer engagement slot is adjacent an opening between the upper edges of the jaws to facilitate hands-free engagement of the resilient member on the wire of the mop head. The inner portion of the engagement slot is substantially closed due to the compression from the integrally-formed spring, with the integral spring being defined by the respective second inner groove on each jaw of the pair of jaws.

The present invention includes a connecting device for joining a handle to a pivot bar of a cleaning device. For example, the connecting device may join a handle to the pivot bar of a wire support frame of a dust mop. Such a connecting device comprises a handle receiving member defining a longitudinal socket for receiving a handle; a resilient clip-on member having a base; and the base formed integral with or attached to the handle receiving member. The resilient clip-on member includes first and second jaws extending generally parallel from one end of the base. Each of the jaws having a first inner wall and a first outer wall. The first inner wall of the first jaw facing the first inner wall of the second jaw to define a slit having a closed end proximal to the base and an opening end distal to the base. Each inner wall defining a respective first inner groove and a second inner groove. The first inner groove of the first inner wall is opposed to and parallel to the first inner groove of the second inner wall to define an outer engagement slot arranged transversely for receiving the pivot bar of the wire support frame. The second inner groove of the first inner wall is opposed to and parallel the second inner groove of the second inner wall to define an inner slot of an integrally-formed spring for compressing the outer engagement slot, the inner slot arranged in a direction substantially parallel to the outer engagement slot. The inner walls of the jaws comprise portions normally adjacent or normally spaced apart a distance less than the distance required to receive the pivot bar between the jaws. The jaws are deformable away from each other to permit passage of the pivot bar between the jaws. The outer engagement slot is spaced from the proximal and distal ends of the slit. The inner slot is closer than the outer slot to the closed end of the slit or the inner slot is at the closed end of the slit.

In an embodiment, the resilient clip-on member is pivotably attached to a receiving barrel that holds the mop stick in place. Thus, the mop head is tightly held in place with hands free installation and can swivel to facilitate cleaning in difficult to reach areas.

In addition, the present invention can be constructed of an elastomeric material and/or a plastic material. In an embodiment, the invention is made of a unitary construction, so the resilient clip-on member is securely attached to the wire frame without any hardware additional items, such as nuts, bolts, screws, etc.

BRIEF DESCRIPTION OF THE DRAWINGS

For purposes of illustration and not intended to limit the scope of the invention in any way, the aforementioned and other characteristics of the invention will be clear from the following description of a preferred form of the embodiments, given as non-restrictive examples, with reference to the attached drawings wherein:

FIG. 3A is a of side view of the resilient clip-on member and receiving barrel, providing a view of the living hinge;

FIG. 3B is a plan view of the dust mop holder of the present invention that highlights the channel forming the living hinge;

DETAILED DESCRIPTION OF THE INVENTION

The invention will be illustrated in an embodiment typically connecting a dust mop handle to a pivot bar of a wire frame of a dust mop head. However, as indicated above, the present connecting device may connect a handle to other heads of other cleaning devices having a pivot bar, for example, wet mops and push brooms.

Figure 1A:
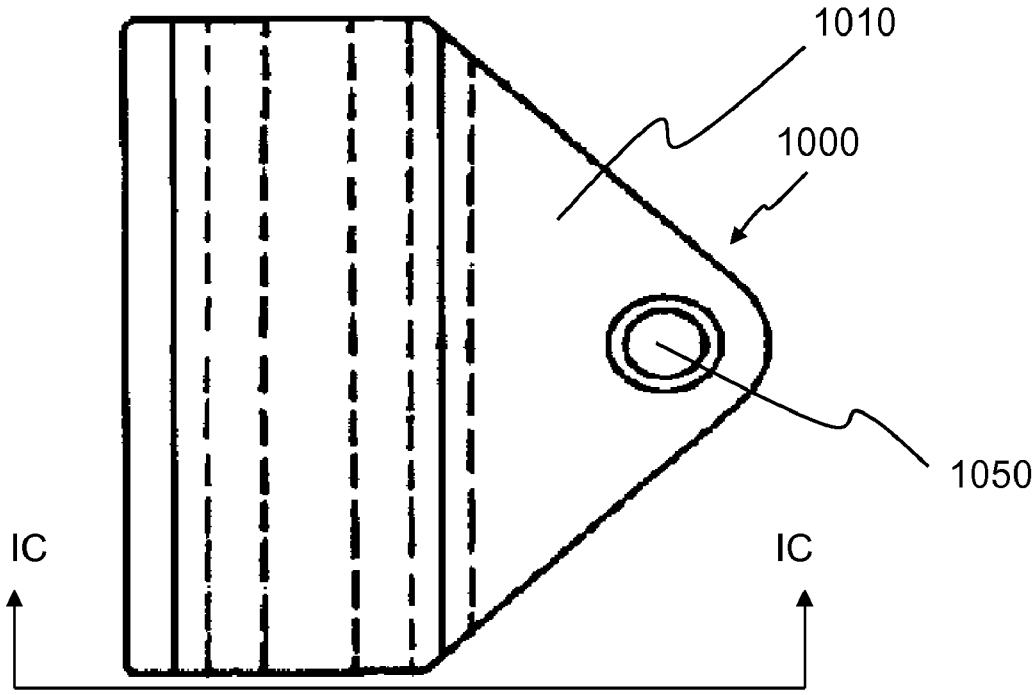
FIG. 1A is a top view of a resilient clip-on holder according to a first embodiment of the invention.
Figure 1B:
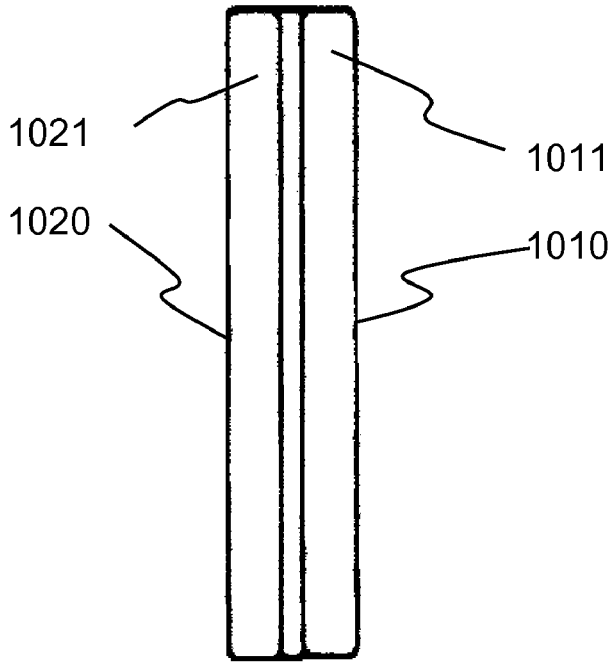
FIG. 1B is front view of the resilient clip-on member shown in FIG. 1A.
Figure 1C:
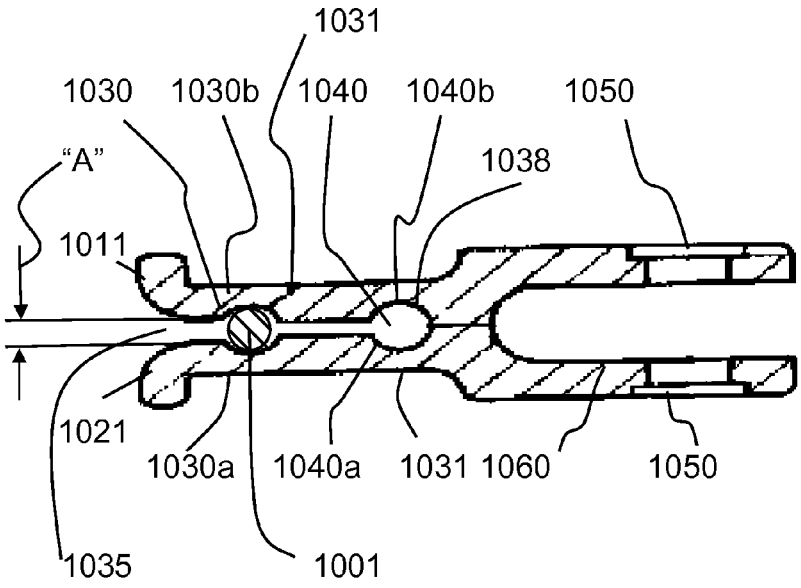
FIG. 1C is a side cross-sectional view of the resilient clip-on member shown in FIG. 1A along view IC-IC, and show a pivot bar.

Referring to FIGS. 1A, 1B and 1C, the resilient clip-on member 1000 is preferably constructed of a single elastomeric and/or plastic material. A single piece may be molded of one piece or be made by molding two halves and permanently attaching or welding together the two halves as shown in FIG. 1C.

The resilient clip-on member 1000 has first and second jaws 1010 and 1020, respectively. Each of the jaws 1010, 1020 has a respective edge 1011, 1021, which are flared (as shown in FIG. 1C), but they could also be beveled (as shown in the photo in FIG. 3A). The jaws being made of resilient or elastomeric material, such as a resilient polymer and defining an open end 1035 and a closed end 1038.

As shown in FIG. 1C, the edges 1011, 1021, are flared to facilitate a wire frame to advance toward the outer engagement slot 1030, where it will be retained by the assistance of the compression from the integrally-formed spring formed by the cooperation of the jaws 1010, 1020 and inner engagement slot 1040. The outer engagement slot 1030, is defined by first inner groove members 1030*a*, 1030*b*, and the integrally-formed spring 1040 is formed by second inner groove members 1040*a*, 1040*b*.

Still referring to FIG. 1C, typically, the outer engagement slot 1030 is typically not completely closed at an outer end. While different sized wire frame members would have different values. A typical range of the space "A" of the outer engagement 1030 slot between the outer edge of the first groove of each jaw ranges from substantially in contact to 3/16ths of an inch, for example 1/16th to 3/16ths of an inch, typically 1/8th of an inch.

The outer engagement slot 1030 receives the engagement portion 1001 (pivot bar) of the wire frame member of the mop head (not shown) and there is tension against the wire due to the integrally formed spring 1040. Once the wire frame member is arranged within the outer engagement slot 1030, the force from the integrally formed spring, aided by the elastomeric property of the resilient clip-on member, will push the two jaws 1010, 1020 toward each other and retain the wire frame by tensioning the outer engagement slot 1030 to substantially contact the pivot bar of the wire frame of the mop head. Typically, the outer engagement slot 1030 has a diameter that substantially corresponds to a diameter of the engagement portion 1001 (pivot bar) of the wire frame of the mop head.

Thus, still referring to FIGS. 1A, 1B and 1C, the clip-on member can be pushed onto the wire frame of the mop head. The closing action by the two sides 1010 and 1020, particularly due to the integrally formed spring 1040 in the area of the inner portion of the engagement slot 1030, tends to assist the outer engagement slot to retain the wire frame member and reduce the tendency of the wire from slipping out of the engagement slot.

As shown in FIGS. 1A and 1C, the resilient clip-on member 1000 may have a pair of aligned pivot holes 1050 in the two sides 1010, 1020 for connecting the member 1000 to a pivot portion 1060 connected to a receiving barrel 1070 (shown in FIG. 2B) of a handle holding portion 1065 via the hole 1075 defined therein.

An artisan understands and appreciates that there are a number of different ways the resilient clip-on member can be pivotably attached to the receiving barrel without departing from the spirit of the invention or the scope of the appended claims. Typically, a fastener such as a pin 1110 (shown in FIG. 3B) can provide a pivotable connection. Other items, such as screws, nuts bolts, rivets, etc. or a hinge mechanism can also be used as a fastener, but it is preferred that the entire structure be made of a unitary substance.

Figure 2A:
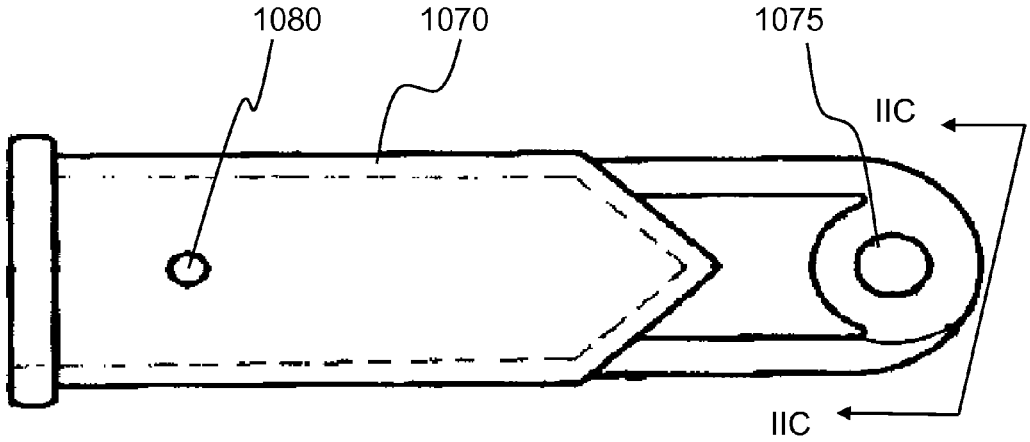
FIG. 2A is a side view of the receiving barrel and clip-on member.
Figure 2B:
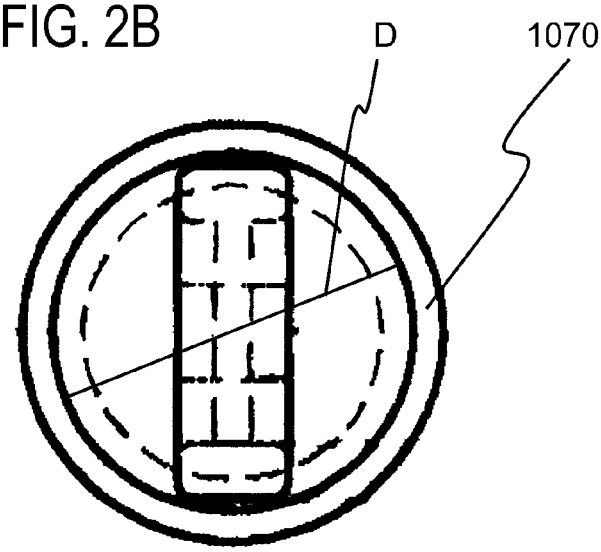
FIG. 2B is a front view of the receiving barrel and clip-on member.
Figure 2C:
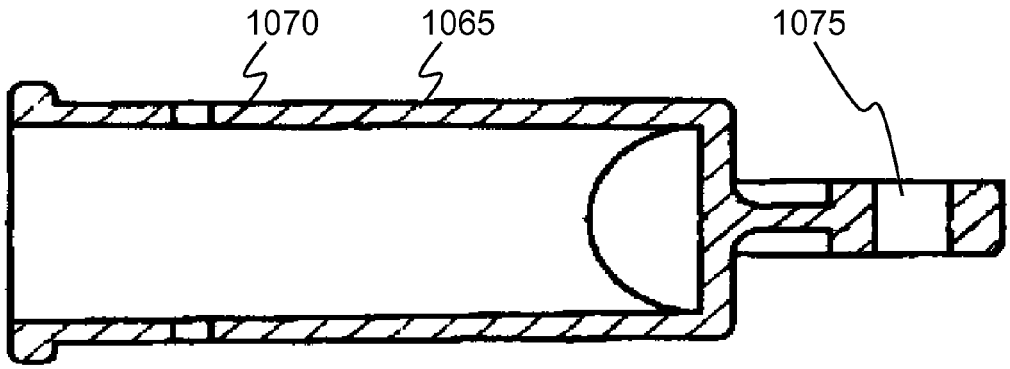
FIG. 2C is a top cross-sectional view of the receiving barrel and clip-on member along view IIC-IIC.
Figure 4:
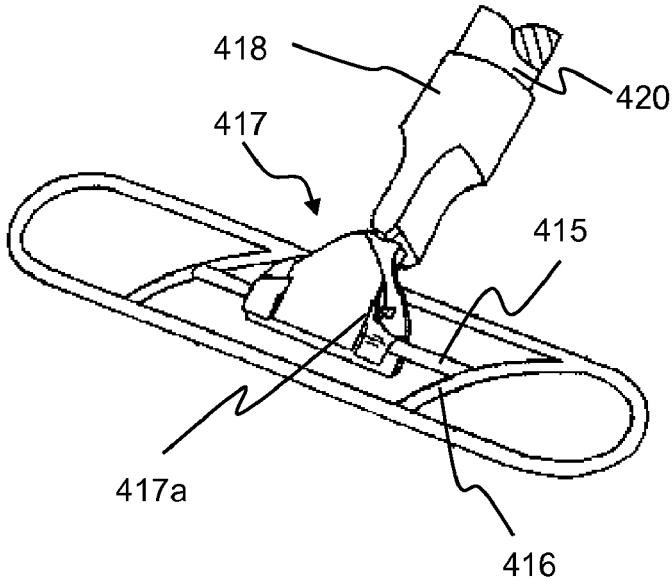
FIG. 4 (PRIOR ART)
FIG. 4 is a view of one prior art dust mop holder.
Figure 5:
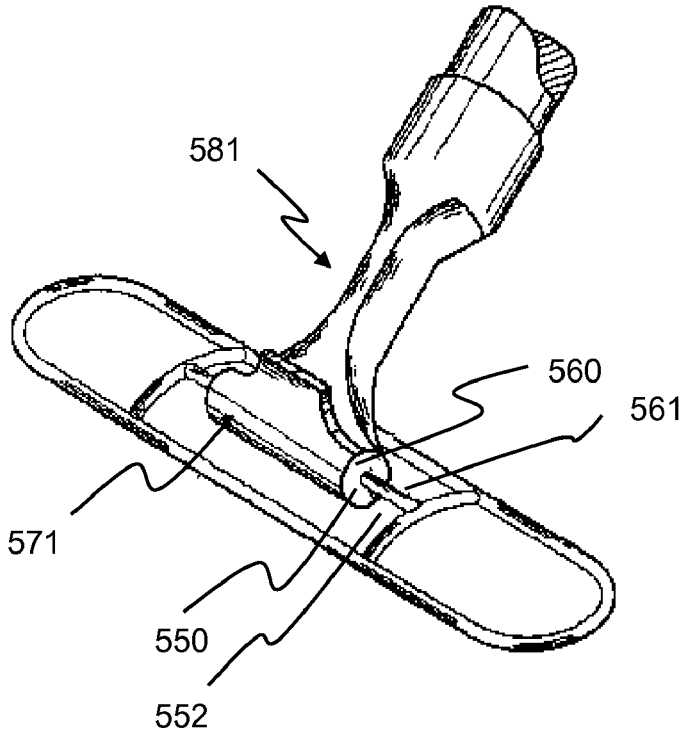
FIG. 5 (PRIOR ART)
FIG. 5 is a view of another prior art dust mop holder.

Still referring to FIGS. 2A and 2B, the diameter D of the receiving barrel 1070 should substantially correspond to the broom or mop stick or handle intended to be used so that there is a somewhat snug fit. In this embodiment, there is a hole 1080 in the sidewall to permit one to install a wood screw, for example, to attach the receiving barrel 1070 to a broom or mop stick (not shown). Of course, while the drawing shows a barrel for receiving a round stick because that is customary shape of a broom stick is cylindrical, the receiving portion barrel corresponds to the shape of the mop stick, and would match the mop stick. For example, if the mop stick is rectangular, the receiving barrel could be rectangular.

As easy as the hands-free operation is to push the resilient clip-on member onto the wire frame, it is also easy to remove the resilient clip-on member without using one's hands. By stepping down on the mop head and pulling up on the broom handle, the tension by the integrally-formed spring formed by the jaws 1010, 1020 and slot 1040 is overcome to facilitate the movement of the clip-on member 1000 to widen the space between the inner walls of the two jaws 1010, 1020, permitting detachment of the resilient clip-on member 1000 from the mop head.

FIG. 1B shows entire sections of the jaws 1010, 1020 as "carved out" channels 1031 relative to the pivot portion 1060. FIG. 3A shows a channel 1000 arranged along an exterior surface of the clip-on member.

FIGS. 3A and 3B are a side view and a plan view of the resilient clip-on connector according to the present invention. Referring to FIG. 3A, the channels 1100 on the exterior surface aid in the molding process. In that regard, it is easier to form the jaws of thinner rather than thicker material, both because of the manufacturing process. Also, the channels 1100 make removal of the clip-on member somewhat easier as well by making it easier to flex the jaws 1010, 1020 of the integral spring. The base of the resilient clip-on member 1000 is attached to the handle attaching portion 1065 by a plastic bolt 1110.

FIG. 3B shows the channels 1100 (one shown) are arranged across the entire width of the side of the jaw 1010, 1020 (jaw 1010 shown). However, it is within the spirit and scope of the claimed invention that there could be a shorter channel portion or a series of channel portions.

There are various changes to the present invention that can be made by a person of ordinary skill in the art within the spirit of the invention and the scope of the appended claims. For example, the outer edges 1011, 1021 of the jaws 1010, 1020 could be shaped in a way other than beveled or flared (e.g. flat, a series of semi circles, stepped).

Also for example, the mop handle can be attached to the receiving barrel in ways other than using screws or other types of fasteners, such as rivets. For example, there can be attachment by bonding, spring biasing, a tongue and groove pattern on the inner portion of the receiving barrel and/or the handle, or even a fastener arranged in the axial direction of the mop handle that might comprise a wood screw.

Although the mop head preferably swivels, this function is not required to benefit from the improvements to the clip-on member according to the present invention. While elastomeric and/or plastic unitary body is preferred, substances other than plastic could be used, albeit a polymer plastic is preferred. Typical polymers from which the clip-on member may be made include a member of the group consisting of polypropylene, nylon, or acetal. Acetal, also known as polyacetal, polyoxymethylene (POM), or polyformaldehyde, is a high performance engineering polymer containing acetal groups. The invention can also in general be made of engineering plastics which regain their original shape after deformation. If an engineering plastic reaches a critical amount of deformation, it may be unable to regain its original shape. Engineering plastics are usually thermoplastic rather than thermosetting. Examples of engineering plastics include polycarbonates, polysulfides, polyimides and polybutylene terephthalate.

It should be apparent that embodiments other than those specifically described above come within the spirit and scope of the present claims. Accordingly, the present invention is not defined by the above description but rather is defined by the claims appended hereto.

We claim:

1. A connecting device for joining a handle to a pivot bar of a wire support frame of a work member comprising:

a handle receiving member defining a longitudinal socket for receiving the handle;

a base formed integral with or attached to the handle receiving member;

a resilient clip-on member extending from the base and including first and second jaws extending generally parallel from one end of the base, each of the jaws having a first inner wall and a first outer wall, the first inner wall of the first jaw facing the first inner wall of the second jaw to define a slit having a closed end proximal to the base and an opening end distal to the base, each inner wall defining at least a respective first inner groove and a second inner groove;

the first inner groove of the first inner wall is opposed to and parallel to the first inner groove of the second inner wall to define an outer engagement slot arranged transversely for receiving the pivot bar;

the second inner groove of the first inner wall is opposed to and parallel the second inner groove of the second inner wall to define an inner slot of an integrally-formed spring for compressing the outer engagement slot, the inner slot arranged in a direction substantially parallel to the outer engagement slot;

the inner walls of the jaws comprise portions normally adjacent or normally spaced apart a distance less than the distance required to receive the pivot bar between the jaws, the jaws being deformable away from each other to permit passage of the pivot bar between the jaws;

the outer engagement slot is spaced from the proximal and distal ends of the slit; and the inner slot is closer than the outer slot to the closed end of the slit or the inner slot is at the closed end of the slit.

2. The connecting device according to claim 1, wherein the first and second jaws have two channels arranged along opposing exterior surfaces of the clip-on member in an axial direction substantially parallel to the outer engagement slot.

3. The connecting device according to claim 1, wherein the outer engagement slot has a diameter that substantially corresponds to a diameter of an engagement portion of the pivot bar of the wire frame.

4. The connecting device according to claim 1, wherein an outer end of the first and second jaws comprise a pair of beveled edges adjacent the outer engagement slot.

5. The connecting device according to claim 1, wherein an outer end of the first and second jaws comprises a pair of flared edges adjacent the outer engagement slot.

6. The connecting device according to claim 5, wherein the outer engagement slot is adjacent an open portion defined by a space between the flared edges of the first and second jaws.

7. The connecting device according to claim 1, wherein the resilient member comprises a unitary structure.

8. The connecting device according to claim 1, wherein the resilient member is made of a polymer plastic.

9. The connecting device according to claim 1, wherein the resilient member is made out of an elastomeric material.

10. The connecting device according to claim 1, wherein the receiving member further comprises a receiving barrel having an inner diameter sized to receive a handle, and wherein the resilient clip-on member is pivotably attached at a pivoting portion to the receiving barrel.

11. The connecting device according to claim 10, further comprising a pivot pin for pivotable attachment of the resilient clip-on member and the receiving barrel.

12. The connecting device according to claim 10, wherein the receiving barrel has at least one opening in a sidewall.

13. The connecting device according to claim 11, further comprising a fastener that is adapted to attach the mop handle to the receiving barrel via the opening in the sidewall of the receiving barrel.

14. The connecting device according to claim 10, wherein the receiving barrel includes a retaining means to retain the mop handle.

15. The connecting device according to claim 10, wherein the receiving barrel is made of plastic.

16. The connecting device according to claim 10, wherein the receiving barrel is made from an elastomeric material.

17. The connecting device according to claim 10, wherein the resilient clip-on member and the receiving barrel are made from the same material.

18. The connecting device according to claim 10, wherein the work member is selected from the group consisting of a dust mop, a wet mop, and a push broom.

19. The connecting device according to claim 10, wherein the work member is a dust mop.

20. A method of making a resilient device for joining a handle to a pivot bar of a wire support frame of a work member comprising (a) providing a resilient clip member having a base and first and second jaws;

(b) arranging the first and second jaws to extend generally parallel from one end of the base, each of the jaws having a first inner wall and a first outer wall, the first inner wall of the first jaw facing the first inner wall of the second jaw, each inner wall defining a respective first inner groove and a second inner groove;

(c) defining an outer engagement slot for engaging the pivot bar formed by the first inner groove of the first inner wall being opposed to and parallel to the first inner groove of the second inner wall, the outer engagement slot being arranged transversely to an axial direction of the first and second jaws and adjacent an end portion of the first and second jaws on an opposite end from the base; and (d) defining an integrally-formed spring formed by the second inner groove of the first inner wall being opposed to and parallel the second inner groove of the second inner wall, so that the integrally-formed spring compresses the outer engagement slot;

(e) providing a handle receiving member defining a longitudinal socket for receiving the handle;

the base formed integral with or attached to the handle receiving member.

21. The method according to claim 20, further comprising the step of:

wherein the handle is a mop handle and providing the handle receiving member comprises providing a receiving barrel having an inner diameter sized to receive the mop handle, and pivotably attaching the resilient clip-on member to the receiving barrel.

22. The method according to claim 21, further comprising the step of:

arranging a hole in a sidewall of the receiving barrel to permit a fastening device to fasten the mop handle to the receiving barrel.

* * * * *

UNITED STATES PATENT AND TRADEMARK OFFICE

CERTIFICATE OF CORRECTION

PATENT NO. : 7,574,777 B1
APPLICATION NO. : 11/415244
DATED : August 18, 2009
INVENTOR(S) : Daniel T. Fuller and David Lee Roberson It is certified that error appears in the above-identified patent and that said Letters Patent is hereby corrected as shown below:

On the Title Page
Please correct the name of the second Inventor listed In the "Inventor" section of the patent, on Page 1, (75) from "Robert Lee Roberson" to --David Lee Roberson--

Signed and Sealed this

Seventeenth Day of November, 2009

David J. Kappos

David J. Kappos
*Director of the United States Patent and Trademark Office*